US009520256B2

(12) United States Patent
Naka et al.

(10) Patent No.: US 9,520,256 B2
(45) Date of Patent: Dec. 13, 2016

(54) ELECTROMAGNETIC CONTACTOR INCLUDING CONTACT BEARING PORTIONS FOR BEARING FIXED CONTACTS

(71) Applicants: FUJI ELECTRIC FA COMPONENTS & SYSTEMS CO., LTD., Chuo-ku, Tokyo (JP); FUJI ELECTRIC CO., LTD., Kawasaki-shi, Kanagawa (JP)

(72) Inventors: Yasuhiro Naka, Kounosu (JP); Kouetsu Takaya, Kounosu (JP); Kenji Suzuki, Kounosu (JP)

(73) Assignees: FUJI FA COMPONENTS & SYSTEMS CO., LTD., Tokyo (JP); FUJI ELECTRIC CO., LTD., Kawasaki-shi, Kanagawa (JP)

( * ) Notice: Subject to any disclaimer, the term of this patent is extended or adjusted under 35 U.S.C. 154(b) by 0 days.

(21) Appl. No.: 14/677,254

(22) Filed: Apr. 2, 2015

(65) Prior Publication Data

US 2015/0213984 A1 Jul. 30, 2015

Related U.S. Application Data

(63) Continuation of application No. PCT/JP2013/005817, filed on Sep. 30, 2013.

(30) Foreign Application Priority Data

Nov. 15, 2012 (JP) ..... 2012-251569

(51) Int. Cl.
*H01H 50/54* (2006.01)
*H01H 50/04* (2006.01)

(52) U.S. Cl.
CPC ..... *H01H 50/54* (2013.01); *H01H 50/04* (2013.01)

(58) Field of Classification Search
CPC ..... H01H 50/54; H01H 50/04; H01H 50/546; H01H 9/443; H01H 1/54
See application file for complete search history.

(56) References Cited

U.S. PATENT DOCUMENTS 6,700,466 B1 * 3/2004 Yamamoto ..... H01H 9/302 218/156
2009/0237191 A1 9/2009 Yano et al.
(Continued)

FOREIGN PATENT DOCUMENTS

CN 201741636 U 2/2011
JP H06-203725 A 7/1994
(Continued)

OTHER PUBLICATIONS

China Patent Office, "Office Action for Chinese Patent Application No. 201380052093.6," Mar. 24, 2016.
(Continued)

*Primary Examiner* — Bernard Rojas
(74) *Attorney, Agent, or Firm* — Manabu Kanesaka

(57) ABSTRACT

An electromagnetic contactor includes a contact device including a pair of fixed contacts and a movable contact contacting to and separating from the pair of fixed contacts. The pair of fixed contacts includes support conductor portions supported with an upper surface of a contact housing case, and C-shaped portions each including an upper plate portion linked to an end portion of the support conductor portion, an intermediate plate portion extending downward from a side of the upper plate portion opposite to that of the other support conductor portion, and a lower plate portion extending from a lower end of the intermediate plate portion toward a side of the other support conductor portion and
(Continued)

formed with a contact portion on an upper surface thereof. The contact housing case includes contact bearing portions bearing a side of the lower plate portions of the pair of fixed contacts opposite to the movable contact.

9 Claims, 11 Drawing Sheets

(56) References Cited

U.S. PATENT DOCUMENTS

| | | | | |
|---|---|---|---|---|
| 2013/0113580 | A1 | 5/2013 | Naka et al. | |
| 2013/0335175 | A1* | 12/2013 | Tachikawa | H01H 1/54 335/147 |

FOREIGN PATENT DOCUMENTS

| | | | |
|---|---|---|---|
| JP | H06-230725 | A | 8/1994 |
| JP | 2005-183285 | A | 7/2005 |

OTHER PUBLICATIONS

PCT, "International Search Report for International Application No. PCT/JP2013/005817".

* cited by examiner

Fig. 4(a)
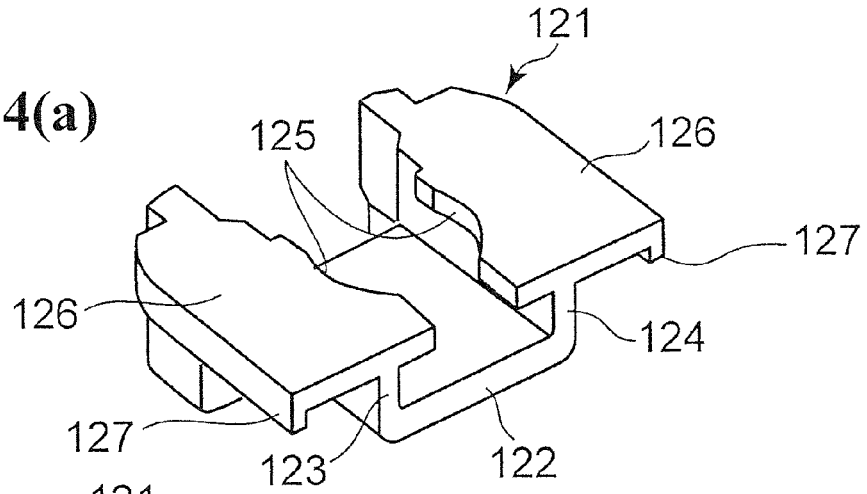
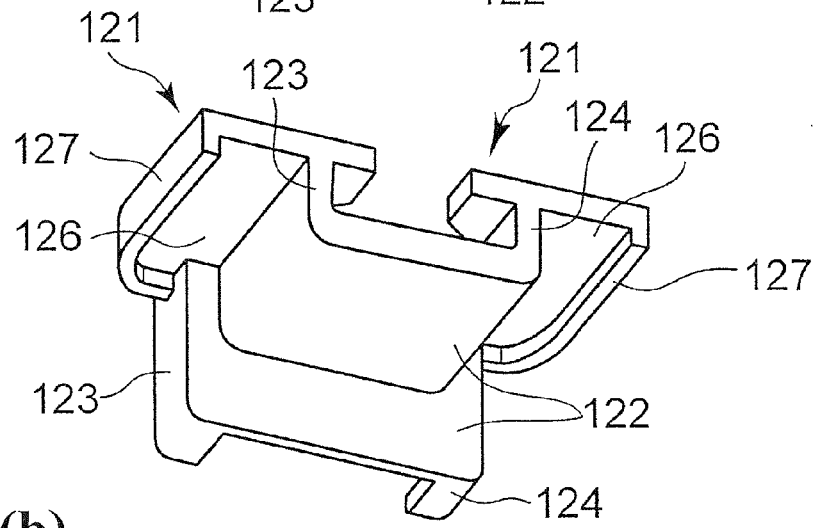
Fig. 4(b)

ELECTROMAGNETIC CONTACTOR INCLUDING CONTACT BEARING PORTIONS FOR BEARING FIXED CONTACTS

RELATED APPLICATIONS

The present application is a continuation Application of International Application No. PCT/JP2013/005817 filed Sep. 30, 2013, and claims priority from Japanese Application No. 2012-251569 filed Nov. 15, 2012, the disclosure of which is hereby incorporated by reference herein in its entirety.

TECHNICAL FIELD

The present invention relates to an electromagnetic contactor having a pair of fixed contacts disposed with a predetermined interval and having a C-shaped portion, and a movable contact disposed so as to be capable of contacting to and separating from the fixed contacts with contact pressure.

BACKGROUND ART

For example, an electromagnetic contactor such that a contact mechanism has a fixed contact and movable contact interposed in a conduction path, wherein the contact mechanism is arranged such that the fixed contact has a C-shape (U-shape, or J-shape), and a Lorentz force is generated opposing an electromagnetic repulsion force generated in the contact opening direction between the fixed contact and movable contact when energizing, has been proposed as an electromagnetic contactor that carries out opening and closing of a current path (for example, refer to PTL 1).

CITATION LIST

Patent Literature

PTL 1: JP-A-2012-28252

SUMMARY OF INVENTION

Technical Problem

Herein, the heretofore known example described in PTL 1 is such that a pair of fixed contacts each has a C-shape and disposed in a state wherein opened portions face each other, a movable contact is disposed in an intermediate portion of the C-shapes and, by the movable contact being pulled down by an electromagnet, the movable contact contacts the pair of fixed contacts at a predetermined contact pressure.

Meanwhile, it is often the case that the fixed contacts are fixed by brazing when being held in a contact housing case, and when fixing the fixed contacts by brazing in this way, it may happen that the fixed contacts are blunted by being heated when brazing. By the movable contact repeatedly contacting the fixed contacts at the predetermined contact pressure in this state, there is an unresolved problem in that there is a possibility of the fixed contacts becoming deformed, causing contact failure.

Therefore, the invention, having been contrived in view of the unresolved problem of the heretofore known example, has an object of providing a highly reliable electromagnetic contactor such that deformation of the fixed contacts is suppressed.

Solution to Problem

In order to achieve the heretofore described object, a first aspect of an electromagnetic contactor according to the invention includes a contact device including a pair of fixed contacts disposed maintaining a predetermined distance and a movable contact disposed contacting to and separating from the pair of fixed contacts. Further, the pair of fixed contacts includes support conductor portions supported with an upper surface of a contact housing case and maintaining a predetermined interval between each other, and C-shaped portions to form a C-shape each including an upper plate portion linked to an end portion of the support conductor portion inside the contact housing case, an intermediate plate portion extending downward from a side of the upper plate portion opposite to that of the other support conductor portion, and a lower plate portion extending from a lower end of the intermediate plate portion toward a side of the other support conductor portion and formed with a contact portion on an upper surface thereof. Also, the contact housing case includes contact bearing portions bearing a side of the lower plate portions of the pair of fixed contacts opposite to that contacting the movable contact.

According to this configuration, contact bearing portions that bear the side of the lower plate portions of the fixed contacts opposite to that contacting the movable contact are provided in the contact housing case, thus, even when the movable contact contacts the fixed contacts at the predetermined contact pressure, it is possible for the stress thereof to be borne by the contact bearing portions, and thus possible to prevent deformation of the fixed contacts.

Also, a second aspect of the electromagnetic contactor according to the invention is such that each of the contact bearing portions includes a projecting portion projecting toward a fixed contact side from a bottom surface portion of the contact housing case, the leading end of the projecting portion is formed with a contact bearing surface, and two sides of the projecting portion are formed with arc extinguishing portions lower than the contact bearing surface.

According to this configuration, the contact bearing portion is formed of a projecting portion projecting to the fixed contact side from a bottom surface portion of the contact housing case, and arc extinguishing portions lower than the contact bearing surface are formed on two sides of the projecting portion, thus, it is possible to widen the arc extinguishing portions, thereby increasing the arc length.

Also, a third aspect of the electromagnetic contactor according to the invention is such that the projecting portion is formed so as to bear only the center of a leading end portion of the lower plate portion in the C-shaped portion of the fixed contact, and arc extinguishing space of the arc extinguishing portion on each of the two sides of the projecting portion is expanded.

According to this configuration, it is possible to further expand the arc extinguishing space of the arc extinguishing portion, and thus possible to increase the arc length, improving interruption performance.

Also, a fourth aspect of the electromagnetic contactor according to the invention is such that the contact housing case is formed of a tubular body made of metal, an insulating cylinder disposed on an inner periphery of the tubular body and having an upper surface being opened, and an insulating plate closing at least the upper surface of the insulating cylinder, wherein the insulating cylinder is formed with the projecting portion and arc extinguishing spaces.

According to this configuration, an insulating cylinder is disposed on the inner side of a metal tubular body, and the projecting portion and arc extinguishing spaces are formed in the insulating cylinder, thus, it is possible to reliably prevent a generated arc from contacting metal and short-circuiting.

Also, a fifth aspect of the electromagnetic contactor according to the invention is such that the pair of fixed contacts except for the contact portions each is covered with an insulating cover, and the insulating cover is formed with an extended portion covering the inner surface of the insulating plate.

According to this configuration, it is possible to cover the C-shaped portion of the fixed contacts with the insulating cover, and an extended portion covering the inner surface of the insulating plate is formed in the insulating cover, thus, it is possible to reliably prevent the arc from reaching the fixed contacts with the extended portion.

Advantageous Effects of Invention

According to the invention, when the fixed contacts are structured to have a C-shaped portion, the side opposite to that contacting the movable contact of a lower plate portion of the C-shaped portion with which the movable contact contacts is borne by a contact bearing portion formed in the contact housing case. Therefore, even when the movable contact repeatedly contacts the fixed contacts at the predetermined contact pressure, it is possible for the stress to be borne by the contact bearing portion, and thus possible to reliably prevent deformation of the C-shaped portion.

BRIEF DESCRIPTION OF DRAWINGS

FIGS. 4(*a*), 4(*b*) are diagrams showing an insulating cover of a contact mechanism, wherein FIG. 4(*a*) is a perspective view seen from above and FIG. 4(*b*) is a perspective view seen from below.

DESCRIPTION OF EMBODIMENTS

Hereafter, a description will be given, based on the drawings, of embodiments of the invention.

Figure 1:
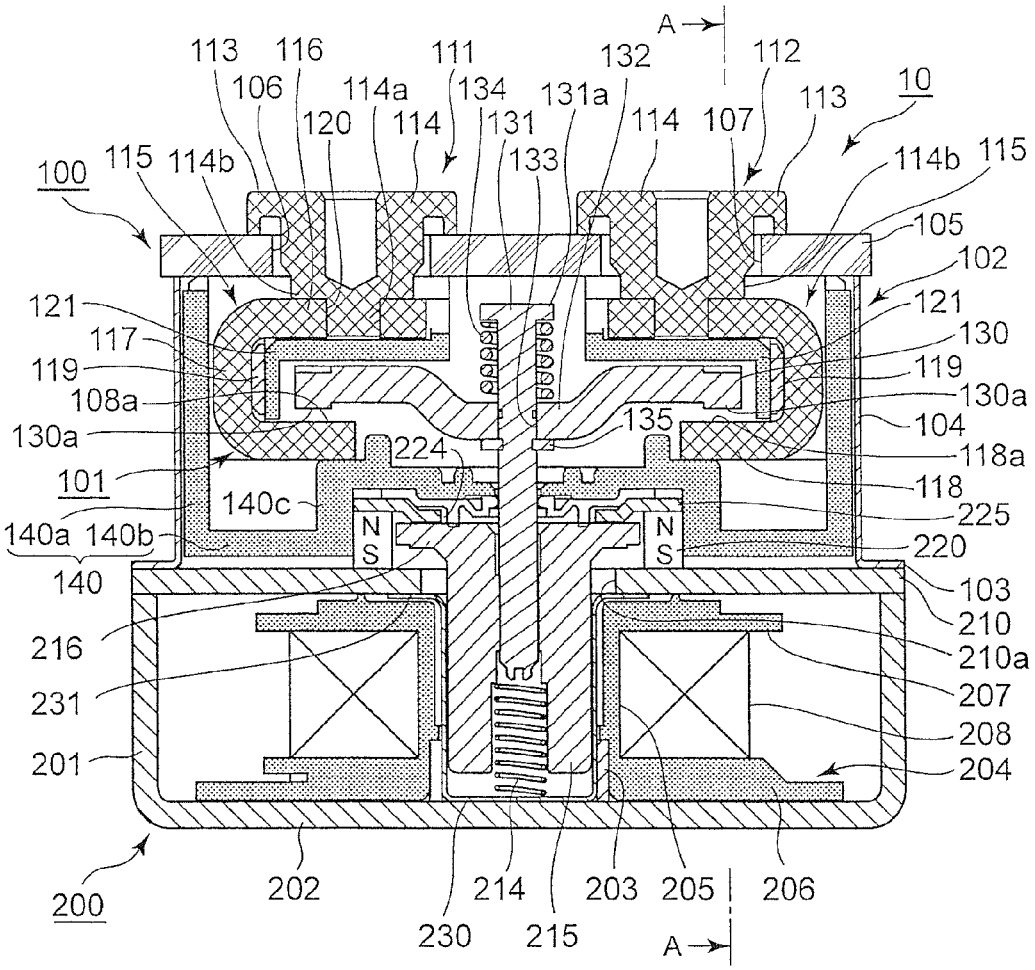
FIG. 1 is a sectional view showing a first embodiment of an electromagnetic contactor according to the invention.
Figure 2B:
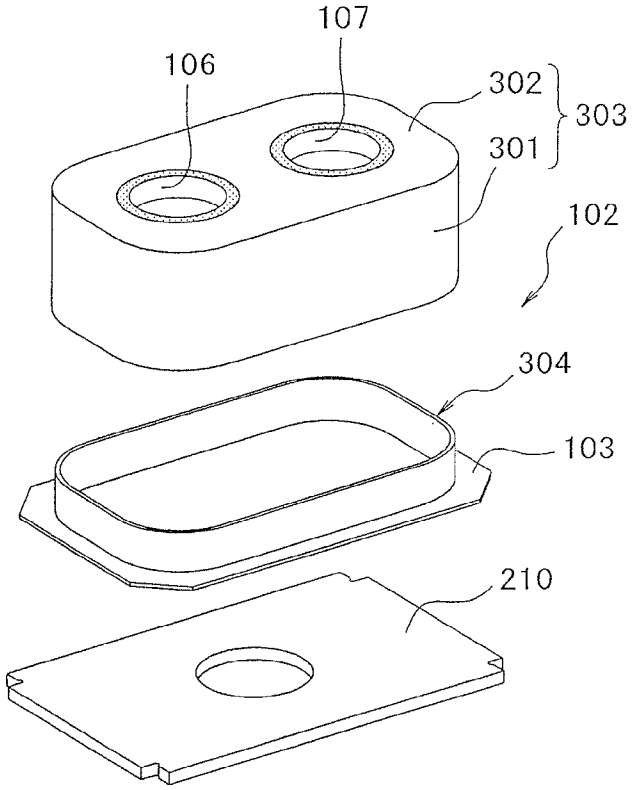
FIGS. 2(*a*), 2(*b*) are exploded perspective views showing a contact housing case of FIG. 1.
Figure 2A:
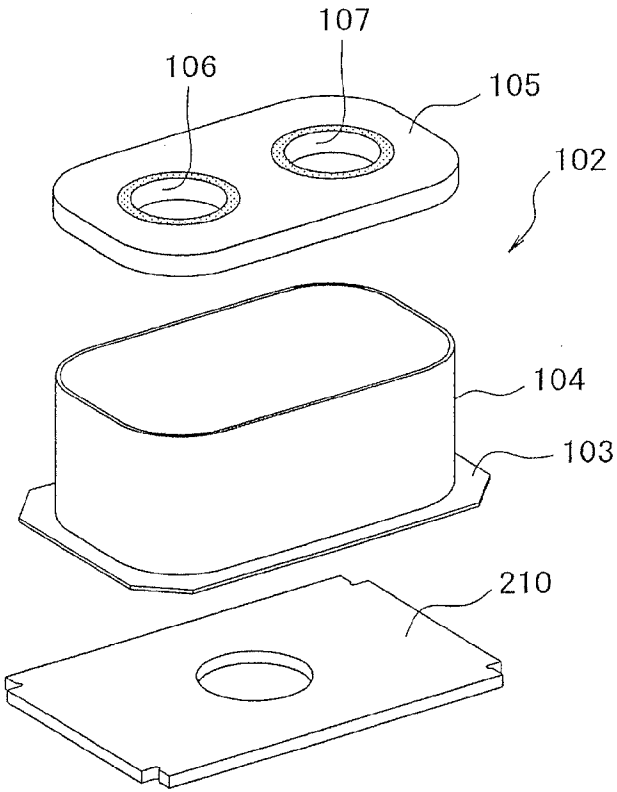

FIG. 1 is a sectional view showing an example of an electromagnetic contactor according to the invention, while FIGS. 2(*a*), 2(*b*) are exploded perspective views of a contact housing case. In FIG. 1 and FIGS. 2(*a*), 2(*b*), reference 10 is an electromagnetic contactor. The electromagnetic contactor 10 is configured of a contact device 100 in which is disposed a contact mechanism, and an electromagnet unit 200 that drives the contact device 100.

The contact device 100 has a contact housing case 102 that houses a contact mechanism 101, as is clear from FIG. 1 and FIGS. 2(*a*), 2(*b*). The contact housing case 102 includes a metal tubular body 104 having on a metal lower end portion a flange portion 103 protruding outward, and a fixed contact support insulating base plate 105 formed of a plate-like ceramic insulating base plate that closes off the upper end of the metal tubular body 104, as shown in FIG. 2(*a*).

The metal tubular body 104 is such that the flange portion 103 thereof is seal joined and fixed to an upper magnetic yoke 210 of the electromagnet unit 200, to be described hereafter.

Also, through holes 106 and 107 through which is inserted a pair of fixed contacts 111 and 112, to be described hereafter, are formed with a predetermined interval in a central portion of the fixed contact support insulating base plate 105. A metalizing process is performed around the through holes 106 and 107 on the upper surface side of the fixed contact support insulating base plate 105, and in a position on the lower surface side that contacts the tubular body 104. Further, the fixed contact support insulating base plate 105 is brazed to the upper surface of the tubular body 104.

The contact mechanism 101, as shown in FIG. 1, includes the pair of fixed contacts 111 and 112 inserted through and fixed in the through holes 106 and 107 of the fixed contact support insulating base plate 105 of the contact housing case 102. Each of the fixed contacts 111 and 112 includes a support conductor portion 114, having on an upper end a flange portion 113 protruding outward, inserted through the through holes 106 and 107 of the fixed contact support insulating base plate 105, and a C-shaped portion 115, the inner side of which is opened, linked to the support conductor portion 114 and disposed on the lower surface side of the fixed contact support insulating base plate 105.

The C-shaped portion 115 is formed in a C-shape of an upper plate portion 116 extending to the outer side along the line of the lower surface of the fixed contact support insulating base plate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction in which the fixed contacts 111 and 112 face, wherein the upper plate portion 116 is added to an L-shape formed by the intermediate plate portion 117 and lower plate portion 118.

Herein, the support conductor portion 114 and C-shaped portion 115 are fixed by, for example, brazing in a state in which a pin 114*a* formed protruding on the lower end surface of the support conductor portion 114 is inserted into a through hole 120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin 114*a* and an internal thread formed in the through hole 120, and the two are screwed together.

Also, a magnetic plate 119 of a C-shape seen in plan view is mounted so as to cover the inner surface of the intermediate plate portion 117 of the C-shaped portions 115 of the fixed contacts 111 and 112. By the magnetic plate 119 being disposed so as to cover the inner surface of the intermediate plate portion 117 in this way, it is possible to shield against a magnetic field generated by current flowing through the intermediate plate portion 117.

It is possible to shield against a magnetic field generated by current flowing through the intermediate plate portion 117, and the magnetic plate 119 may also be formed so as to cover the periphery of the intermediate plate portion 117.

Figure 3:
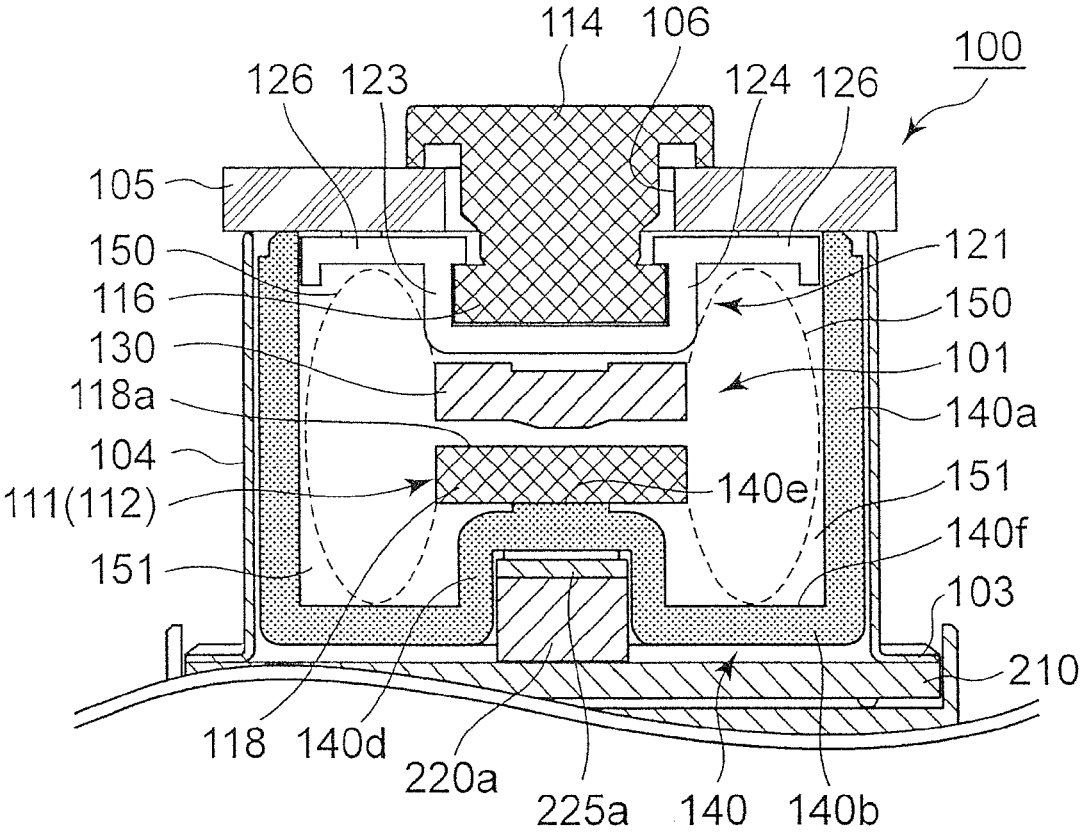
FIG. 3 is a sectional view along the line A-A of FIG. 1.

Further, an insulating cover 121, made of a synthetic resin material, that regulates arc generation is mounted in the C-shaped portion 115 of each of the fixed contacts 111 and 112. The insulating cover 121 covers the inner peripheral surfaces of the upper plate portion 116 and intermediate plate portion 117 of the C-shaped portion 115, and also covers the inner surface of the fixed contact support insulating base plate 105, as shown in FIG. 3 and FIGS. 4(*a*) and 4(*b*).

The insulating cover 121 includes an L-shaped plate portion 122, side plate portions 123 and 124, fitting portions 125, and extended portions 126. The L-shaped plate portion 122 is formed in an L-shape that follows the inner surfaces of the upper plate portion 116 and intermediate plate portion 117. The side plate portions 123 and 124 extend upward and outward from each of front and back end portions of the L-shaped plate portion 122, and cover side surfaces of the upper plate portion 116 and intermediate plate portion 117 of the C-shaped portion 115. The fitting portions 125 are formed inward from the upper ends of the side plate portions 123 and 124, and fit onto a small diameter portion 114*b* formed on the support conductor portion 114 of the fixed contacts 111 and 112. The extended portions 126 extend to the sides opposite to those of the fitting portions 125, and cover the inner surface of the fixed contact support insulating base plate 105. Flange portions 127 contacting the inner surface of the tubular body 104 are formed on the outer peripheral side of the lower surface of the extended portions 126.

Figure 5A:
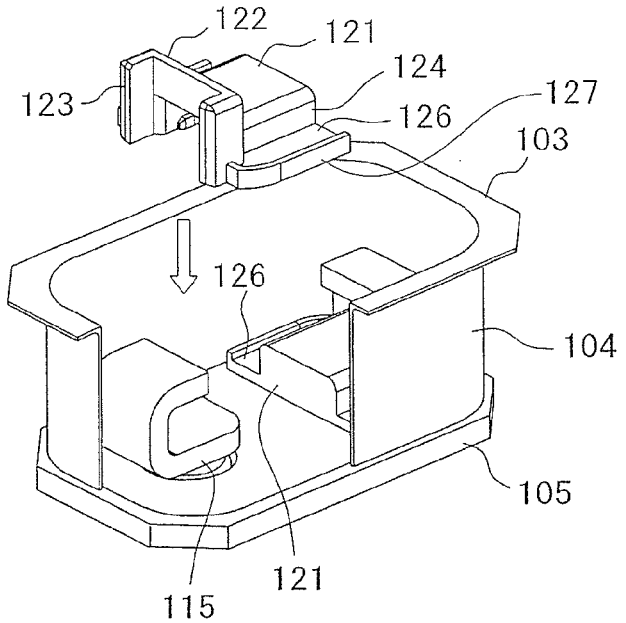
FIGS. 5(*a*)-5(*c*) are perspective views showing an insulating cover mounting method.
Figure 5B:
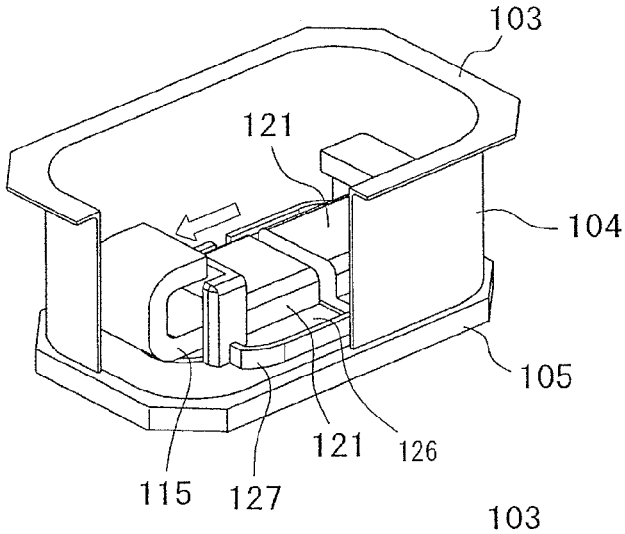
Figure 5C:
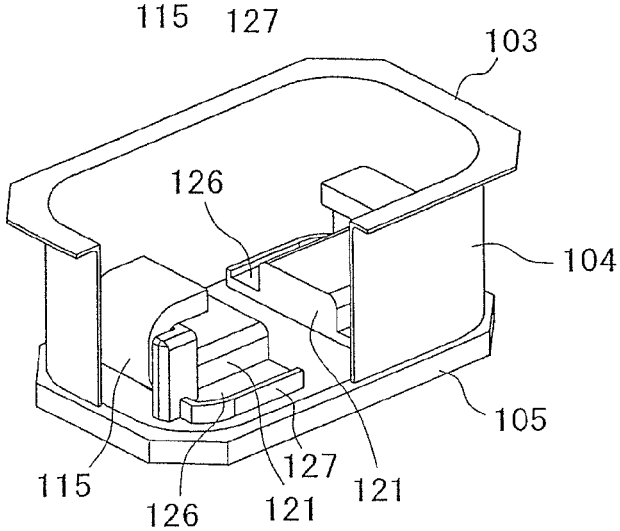

Further, with the contact housing case 102 after the fixed contacts 111 and 112 are installed in a state wherein the fixed contact support insulating base plate 105 is on the lower side, as shown in, for example, FIG. 5(*a*), the insulating cover 121 is inserted between the fixed contacts 111 and 112 from an upper aperture portion, with the insulating cover 121 in a state vertically the reverse of that in FIGS. 4(*a*) and 4(*b*).

Next, with the insulating cover 121 in a state wherein the fitting portions 125 and extended portions 126 are parallel with the fixed contact support insulating base plate 105, as shown in FIG. 5(*b*), the fitting portions 125 are engaged with and fixed to the small diameter portion 114*b* of the support conductor portions 114 of the fixed contacts 111 and 112 by the insulating cover 121 being pushed to the outer side, as shown in FIG. 5(*c*).

By the insulating cover 121 being mounted in the C-shaped portions 115 of the fixed contacts 111 and 112 in this way, only the upper surface side of the lower plate portion 118 of the inner peripheral surface of the C-shaped portion 115 is exposed, and is taken to be a contact portion 118*a*.

Further, a movable contact 130 is disposed in such a way that the two end portions are disposed in the C-shaped portions 115 of the fixed contacts 111 and 112. The movable contact 130 is supported by a connecting shaft 131 fixed to a movable plunger 215 of the electromagnet unit 200, to be described hereafter. The movable contact 130 is such that a central portion in the vicinity of the connecting shaft 131 protrudes downward, whereby a depressed portion 132 is formed, and a through hole 133 through which the connecting shaft 131 is inserted is formed in the depressed portion 132, as shown in FIG. 1.

A flange portion 131*a* protruding outward is formed on the upper end of the connecting shaft 131. With the connecting shaft 131 in a state inserted from the lower end side into a contact spring 134, the connecting shaft 131 is inserted through the through hole 133 of the movable contact 130. Further, the upper end of the contact spring 134 contacts the flange portion 131*a*, and the movable contact 130 is positioned on the connecting shaft 131 using, for example, a C-ring 135 so as to obtain a predetermined urging force from the contact spring 134.

The movable contact 130, in a released state, takes on a state wherein contact portions 130*a* at either end and the contact portions 118*a* of the lower plate portions 118 of the C-shaped portions 115 of the fixed contacts 111 and 112 are separated from each other and maintaining a predetermined interval. Also, the movable contact 130 is set so that, in an engaged position, the contact portions at either end contact the contact portions 118*a* of the lower plate portions 118 of the C-shaped portions 115 of the fixed contacts 111 and 112 at a predetermined contact pressure from the contact spring 134.

Figure 6:
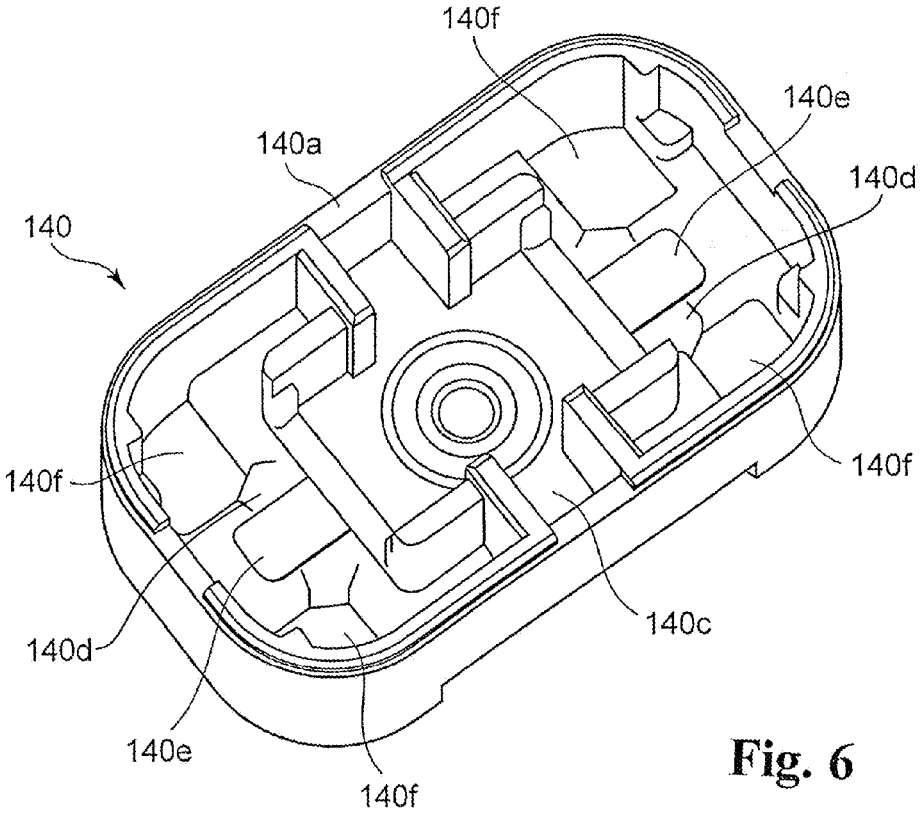
FIG. 6 is a perspective view showing an insulating cylinder.

Furthermore, an insulating cylinder 140, formed in a bottomed tubular form of a tubular portion 140*a* and a bottom plate portion 140*b* formed on the lower surface side of the tubular portion 140*a*, as shown in FIG. 1, FIG. 3, and FIG. 6, is disposed on the inner peripheral surface of the tubular body 104 of the contact housing case 102. The insulating cylinder 140 is made of, for example, a synthetic resin, and the tubular portion 140*a* and bottom plate portion 140*b* are formed integrally.

The bottom plate portion 140*b*, as shown in FIG. 6, includes a central depressed portion 140*c*, which holds on the lower surface side thereof a peripheral flange 216 of the movable plunger 215, to be described hereafter, and reverse oriented depressed portions 140*d*, adjacent to the depressed portion 140*c*, as narrow contact bearing portions, narrower than the width of the lower plate portion 118 of the fixed contacts 111 and 112, that house projecting portions 220*a* for positioning a permanent magnet 220, to be described hereafter, and projecting portions 225*a* for positioning an auxiliary yoke 225.

Further, the upper surfaces of the depressed portions 140*d* are flat contact bearing surfaces 140*e* acting as contact bearing portions that bear the bottom surface side of the contact portions 118*a* of the fixed contacts 111 and 112. Furthermore, arc extinguishing portions 140*f*, of a height less than that of the contact bearing surfaces 140*e* and forming deepest portions approaching the upper magnetic yoke 210, to be described hereafter, are formed in the four corners of the bottom plate portion 140*b* of the insulating cylinder 140 that forms the two sides of the contact bearing surfaces 140*e*.

Figure 7:
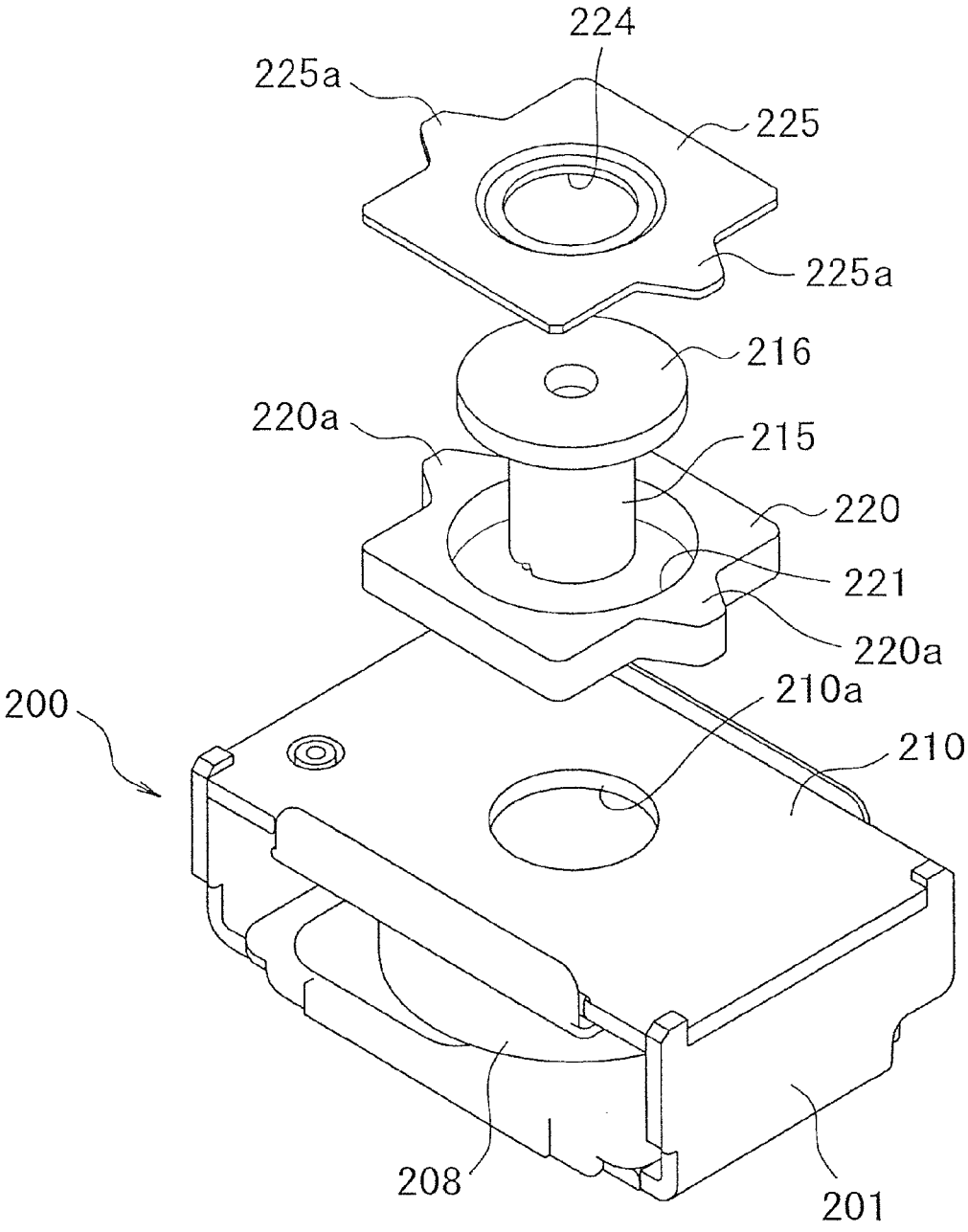
FIG. 7 is an exploded perspective view of an electromagnet unit.

The electromagnet unit 200, as shown in FIG. 1 and FIG. 7, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed on the outer side of the cylindrical auxiliary yoke 203.

The spool 204 includes a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from the upper end of the central cylinder portion 205. Further, an exciting coil 208 is mounted wound in a housing space formed of the central cylinder portion 205, lower flange portion 206, and upper flange portion 207.

The upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. The peripheral flange portion 216, protruding outward in a radial direction, is formed on the movable plunger 215, on an upper end portion protruding upward from the upper magnetic yoke 210.

Also, a permanent magnet 220 formed in a ring form of, for example, a rectangular external form and having a circular central aperture 221 is fixed to the upper surface of the upper magnetic yoke 210 so as to enclose the peripheral flange portion 216 of the movable plunger 215. The permanent magnet 220 is magnetized in an up-down direction, that is, a thickness direction, so that the upper end side is, for example, an N-pole while the lower end side is an S-pole. The positioning projecting portions 220*a* are formed on either side surface of the permanent magnet 220 facing the movable contact 130. The form of the central aperture 221 of the permanent magnet 220 is a form tailored to the form of the peripheral flange portion 216, while the form of the outer peripheral surface can be an arbitrary form such as circular or rectangular.

Further, an auxiliary yoke 225 of the same external form as the permanent magnet 220, and having a through hole 224 of an inner diameter smaller than the outer diameter of the peripheral flange portion 216 of the movable plunger 215, is fixed to the upper end surface of the permanent magnet 220. The positioning projecting portions 225*a* are formed corresponding to the positioning projecting portions 220*a* of the permanent magnet 220 on the auxiliary yoke 225, as shown in FIG. 7. The peripheral flange portion 216 of the movable plunger 215 contacts the lower surface of the auxiliary yoke 225.

Also, the connecting shaft 131 that supports the movable contact 130 is screwed to the upper end surface of the movable plunger 215.

Further, the movable plunger 215 is covered with a cap 230 made of a non-magnetic body and formed in a bottomed tubular form. A flange portion 231 formed extending outward in a radial direction on an opened end of the cap 230 is seal joined to the lower surface of the upper magnetic yoke 210. Further, a hermetic receptacle, wherein the contact housing case 102 and cap 230 are in communication via the through hole 210*a* of the upper magnetic yoke 210, is formed. A gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

Herein, it is assumed that the fixed contact 111 is formed of, for example, a power supply source that supplies a large current, while the fixed contact 112 is connected to a load.

In this state, the exciting coil 208 in the electromagnet unit 200 is in a non-exciting state, and there exists a released state wherein no exciting force causing the movable plunger 215 to descend is being generated in the electromagnet unit 200.

In this released state, the movable plunger 215 is urged in an upward direction away from the upper magnetic yoke 210 by the return spring 214. Simultaneously with this, a suctioning force created by the magnetic force of the permanent magnet 220 acts on the auxiliary yoke 225, and the peripheral flange portion 216 of the movable plunger 215 is suctioned. Because of this, the upper surface of the peripheral flange portion 216 of the movable plunger 215 contacts the lower surface of the auxiliary yoke 225.

Consequently, the contact portions 130*a* of the movable contact 130 of the contact mechanism 101 linked to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted state, and the contact mechanism 101 is in an opened contact state.

In this way, as the urging force of the return spring 214 and the suctioning force of the annular permanent magnet 220 both act on the movable plunger 215 when the electromagnet unit 200 is in the released state, there is no unplanned downward movement of the movable plunger 215 due to vibration, shock, or the like, from the exterior, and it is thus possible to reliably prevent malfunction.

On the exciting coil 208 of the electromagnet unit 200 being excited in the released state, an exciting force is generated in the electromagnet unit 200, and the movable plunger 215 is pressed downward against the urging force of the return spring 214 and the suctioning force of the annular permanent magnet 220.

Further, the movable plunger 215 descends swiftly against the urging force of the return spring 214 and the suctioning force of the annular permanent magnet 220. The descent of the movable plunger 215 is stopped by the lower surface of the peripheral flange portion 216 contacting the upper surface of the upper magnetic yoke 210.

By the movable plunger 215 descending in this way, the movable contact 130 linked to the movable plunger 215 via the connecting shaft 131 also descends, and the contact portions 130*a* contact the contact portions 118*a* of the fixed contacts 111 and 112 at the contact pressure of the contact spring 134.

Because of this, there exists a closed contact state wherein the large current of the external power supply source is supplied via the fixed contact 111, movable contact 130, and fixed contact 112 to the load.

When the movable contact 130 contacts the contact portions 118*a* on the upper surface sides of the lower plate portions 118 of the fixed contacts 111 and 112 at the predetermined contact pressure of the contact spring 134 in this way, the sides of the lower plate portions 118 of the fixed contacts 111 and 112 opposite to the sides contacting the movable contact 130 are borne by the flat contact bearing surfaces 140*e* includes the depressed portions 140*d* formed in the insulating cylinder 140. Because of this, it is possible to bear the contact pressure of the movable contact 130 with the flat contact bearing surfaces 140*e*, and thus possible to reliably prevent the lower plate portions 118 of the fixed contacts 111 and 112 from deforming.

Consequently, when causing the fixed contacts 111 and 112 to be held in the fixed contact support insulating base plate 105, it is possible to reliably prevent the lower plate portions 118 from deforming when the movable contact 130 contacts at the predetermined contact pressure, even when the fixed contacts 111 and 112 are blunted due to being heated by the brazing process.

When interrupting the supply of current to the load when the contact mechanism 101 is in the closed contact state, the exciting of the exciting coil 208 of the electromagnet unit 200 is stopped.

Because of this, there is no longer an exciting force causing the movable plunger 215 to move downward in the electromagnet unit 200, because of which the movable plunger 215 is raised by the urging force of the return spring 214, and the suctioning force of the annular permanent magnet 220 increases as the peripheral flange portion 216 comes close to the auxiliary yoke 225.

By the movable plunger 215 rising, the movable contact 130 linked via the connecting shaft 131 rises. As a result of this, the movable contact 130 is contacting the fixed contacts 111 and 112 as long as contact pressure is applied by the contact spring 134. Subsequently, there starts an opened contact state, wherein the movable contact 130 moves upward away from the fixed contacts 111 and 112 at the point at which the contact pressure of the contact spring 134 stops.

On the opened contact state starting, an arc is generated between the contact portions 118*a* of the fixed contacts 111 and 112 and the contact portions 130*a* of the movable contact 130, and the state in which current is conducted continues due to the arc. At this time, as the insulating cover 121 is mounted covering the upper plate portion 116 and intermediate plate portion 117 of the C-shaped portions 115 of the fixed contacts 111 and 112, it is possible to cause the arc to be generated only between the contact portions 118*a* of the fixed contacts 111 and 112 and the contact portions 130*a* of the movable contact 130.

Because of this, it is possible to stabilize the arc generation state by reliably preventing the arc from moving above the C-shaped portions 115 of the fixed contacts 111 and 112, and thus possible to improve arc extinguishing performance. Moreover, as both side surfaces of the fixed contacts 111 and 112 are also covered by the insulating cover 121, it is also possible to reliably prevent the leading end of the arc from short-circuiting.

Also, the upper plate portion 116 and intermediate plate portion 117 of the C-shaped portion 115 are covered by the insulating cover 121. Because of this, it is possible to maintain an insulating distance with the insulating cover 121 between the two end portions of the movable contact 130 and the upper plate portion 116 and intermediate plate portion 117 of the C-shaped portions 115, and thus possible to reduce the height in the direction in which the movable contact 130 can move. Consequently, it is possible to reduce the size of the contact device 100.

Furthermore, the insulating cover 121 has the extended portions 126 extending integrally with the side plate portions 123 and 124 to the sides opposite to those of the fitting portions 125, and the extended portions 126 cover the inner surface of the fixed contact support insulating base plate 105, as shown in FIG. 3. Because of this, an arc 150 generated between the movable contact 130 and fixed contacts 111 and 112 can be considerably extended and extinguished in arc extinguishing spaces 151 formed to the sides of the arc 150, as shown in FIG. 3, and it is thus possible to improve interruption performance.

Herein, the arc extinguishing spaces 151 are formed of the side plate portions 123 and 124 and extended portions 126 of the insulating cover 121, the tubular portion 140*a* of the insulating cylinder 140, and the arc extinguishing portions 140*f* formed in the bottom plate portion 140*b*, and are completely enclosed with no metal portion exposed. Because of this, it is possible to reliably prevent the arc from reaching the support conductor portions 114 or C-shaped portions 115 of the fixed contacts 111 and 112, and thus possible to reliably avoid a state wherein the arc contacts between the arc extinguishing spaces 151 and the metal portions, and short-circuits.

Furthermore, the insulating cover 121 can be mounted on the fixed contacts 111 and 112 simply by the fitting portions 125 being fitted onto the small diameter portions 114*b* of the fixed contacts 111 and 112, and mounting onto the fixed contacts 111 and 112 can thus be easily carried out.

In the heretofore described embodiment, a description has been given of a case in which the sides of the lower plate portions 118 of the fixed contacts 111 and 112 opposite to the sides contacting the movable contact 130 are borne by the contact bearing surfaces 140*e*, narrower than the width of the lower plate portion 118, formed on the upper surfaces of the depressed portions 140*d*. However, the invention not being limited to the heretofore described configuration, the depressed portions 140*d* may be changed to narrow plate-form portions 170, and the upper surfaces of the plate-form portions 170 adopted as contact bearing surfaces 171, as shown in FIG. 8 and FIG. 9.

Figure 8:
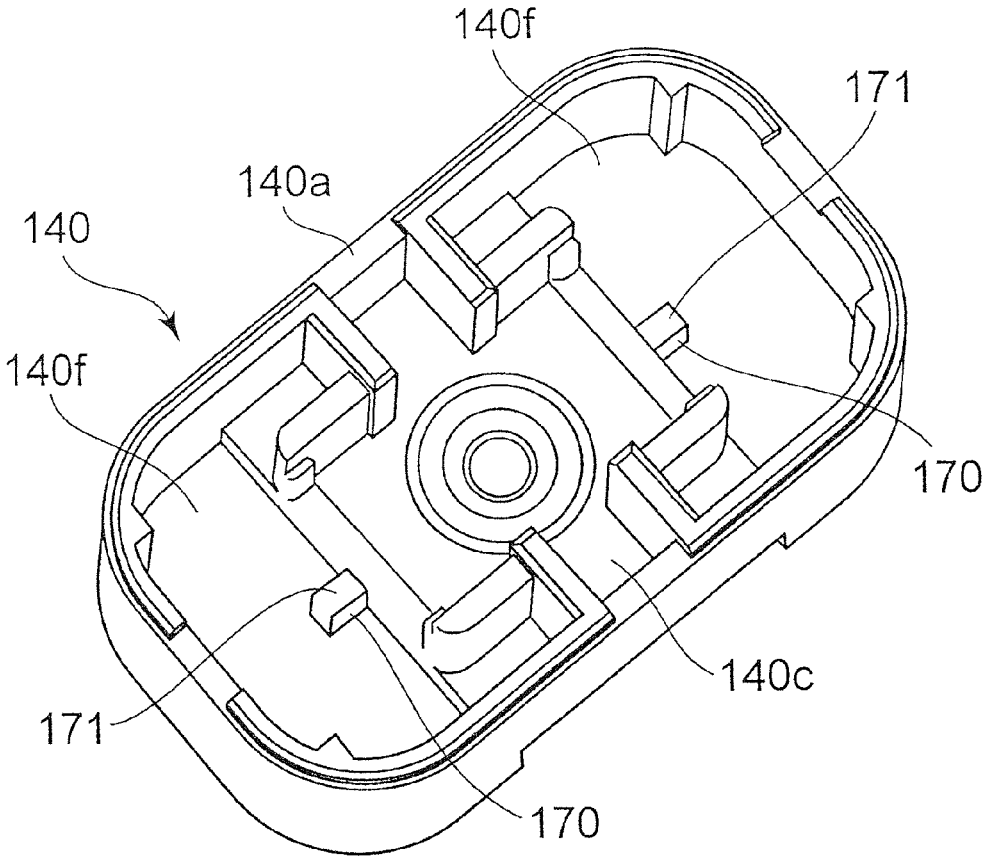
FIG. 8 is a perspective view of an insulating cylinder showing another embodiment of the invention.
Figure 9:
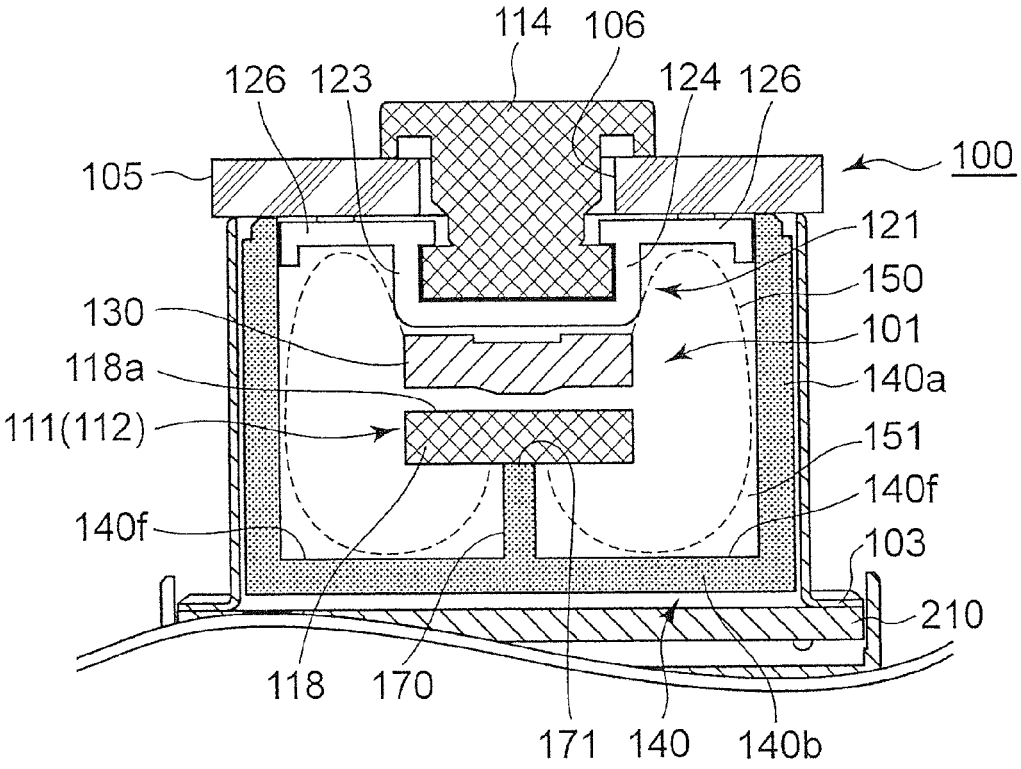
FIG. 9 is the same sectional view as FIG. 3, showing another embodiment of the invention.

In this case, it is preferable that the distance by which the plate-form portions 170 project from the depressed portion 140*c* is short, as shown in FIG. 8, and only a central portion of the leading ends of the lower plate portions 118 of the fixed contacts 111 and 112 is borne by the contact bearing surfaces 171. Because of this, it is possible to increase the width of the arc extinguishing portions 140*f* on either side of the plate-form portions 170, and thus possible to form wider arc extinguishing spaces 151, as shown in FIG. 9. Because of this, it is possible to carryout reliable arc extinguishing by increasing the length of the extended arc, as shown in FIG. 9, and thus possible to further improve interruption performance.

Also, in the heretofore described embodiment, a description has been given of a case in which the contact housing case 102 of the contact mechanism 100 includes the tubular body 104 and fixed contact support insulating base plate 105 but, not being limited to this, other configurations can be adopted. For example, as shown in FIG. 2(*b*), the configuration may be such that a tubular portion 301 and an upper surface plate portion 302 closing off the upper end of the tubular portion 301 are formed integrally of a ceramic or a synthetic resin material, thereby forming a tub-form body 303, a metal foil is formed on an opened end surface side of the tub-form body 303 by a metalizing process, and a metal connection member 304 is seal joined to the metal foil, thus forming the contact housing case 102.

Figure 10A:
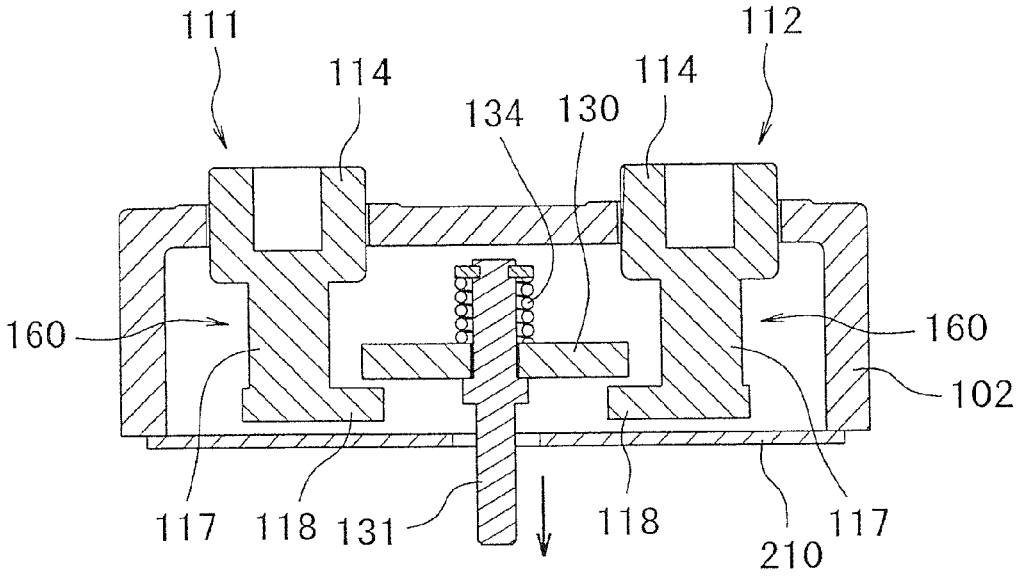
FIGS. 10(*a*), 10(*b*) are diagrams showing a modification example of a contact device of the invention, wherein FIG. 10 (*a*) is a sectional view and FIG. 10(*b*) is a perspective view.
Figure 10B:
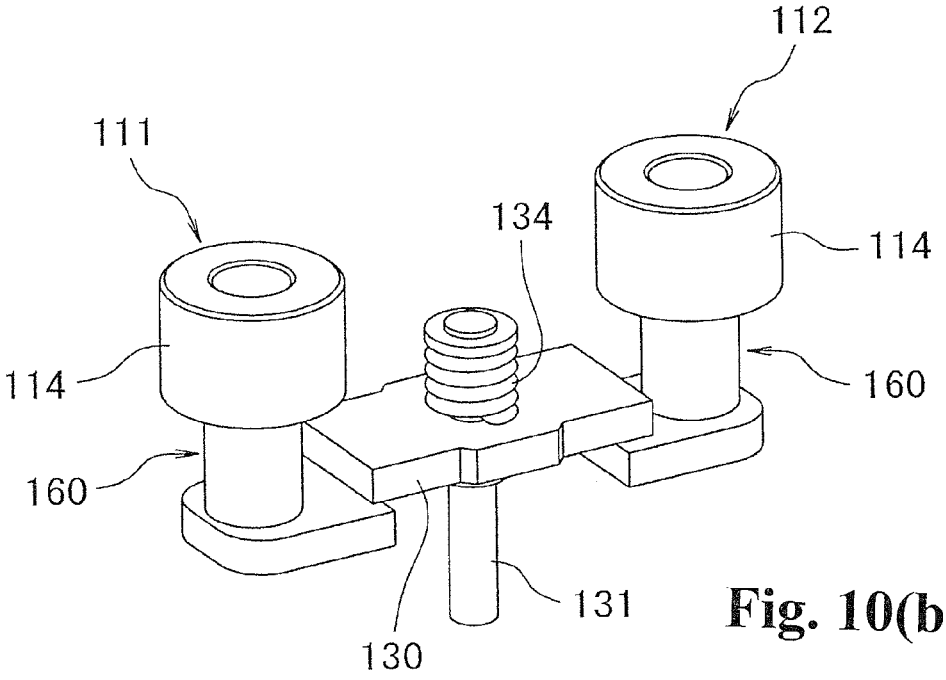

Also, in the heretofore described embodiment, a description has been given of a case in which the C-shaped portion 115 is formed in the fixed contacts 111 and 112 but, not being limited to this, an L-shaped portion 160 having a form such that the upper plate portion 116 in the C-shaped portion 115 is omitted, is linked to the support conductor portion 114, as shown in FIGS. 10(*a*) and 10(*b*). In this case, the insulating cover 121 is mounted so as to cover the lower surface of the support conductor portion 114 and the intermediate plate portion 117.

Figure 11A:
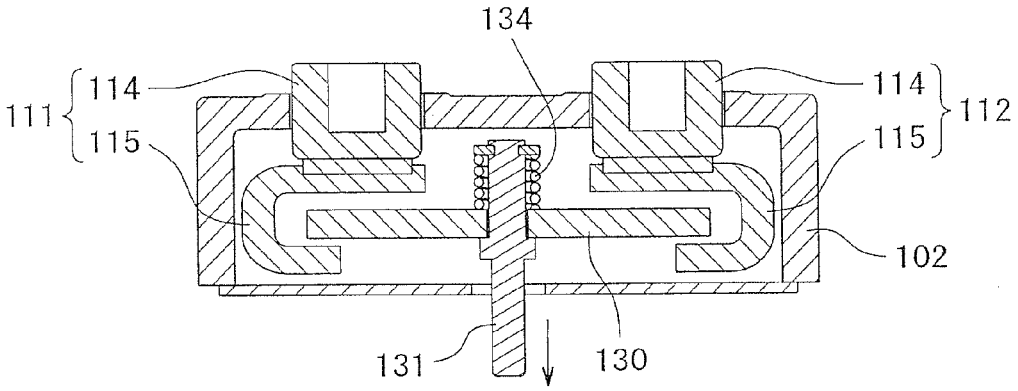
FIGS. 11(*a*), 11(*b*) are diagrams showing another modification example of the contact device of the invention, wherein FIG. 11(*a*) is a sectional view and FIG. 11(*b*) is a perspective view.
Figure 11B:
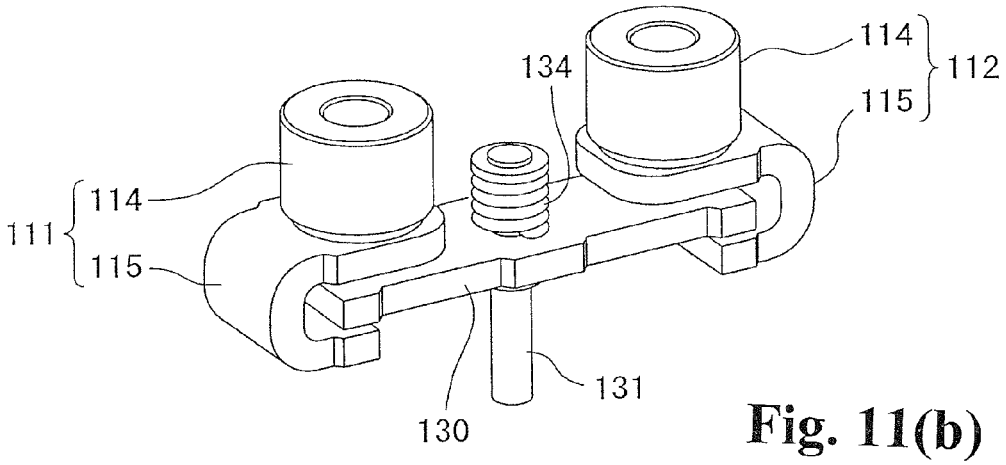

Also, in the heretofore described embodiment, a description has been given of a case in which the movable contact 130 has the depressed portion 132 in a central portion but, not being limited to this, the depressed portion 132 may be omitted, forming a flat plate, as shown in FIGS. 11(*a*) and 11(*b*).

Also, in the heretofore described embodiment, a description has been given of a case in which the connecting shaft 131 is screwed to the movable plunger 215, but the movable plunger 215 and connecting shaft 131 may also be formed integrally.

Also, a description has been given of a case in which the linking of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted through the contact spring 134 and movable contact 130, but the structure is not limited to the description above. That is, a positioning large diameter portion may be formed protruding in a radial direction in the C-ring position of the connecting shaft 131, the contact spring 134 disposed after the movable contact 130 contacts the large diameter portion, and the upper end of the contact spring 134 fixed with the C-ring.

Also, the configuration of the electromagnet unit 200 not being limited to the configuration in the heretofore described embodiment, it is possible to apply an arbitrary configuration.

Also, in the heretofore described embodiment, a description has been given of a case in which a hermetic receptacle includes the contact housing case 102 and cap 230, and gas is encapsulated inside the hermetic receptacle but, not being limited to this, the gas encapsulation may be omitted when the interrupted current is small.

REFERENCE SIGNS LIST

10 . . . Electromagnetic contactor, 11 . . . External insulating receptacle, 100 . . . Contact device, 101 . . . Contact mechanism, 102 . . . Contact housing case, 104 . . . Tubular body, 105 . . . Fixed contact support insulating base plate, 111, 112 . . . Fixed contact, 114 . . . Support conductor portion, 115 . . . C-shaped portion, 116 . . . Upper plate portion, 117 . . . Intermediate plate portion, 118 . . . Lower plate portion, 118*a* . . . Contact portion, 121 . . . Insulating cover, 122 . . . L-shaped plate portion, 123, 124 . . . Side plate portion, 125 . . . Fitting portion, 126 . . . Extended portion, 130 . . . Movable contact, 130*a* . . . Contact portion, 131 . . . Connecting shaft, 132 . . . Depressed portion, 134 . . . Contact spring, 140 . . . Insulating cylinder, 140*a* . . . Tubular body, 140*b* . . . Bottom plate portion, 140*c*, 140*d* . . . Depressed portion, 140*e* . . . Contact bearing surface, 150 . . . Arc, 151 . . . Arc extinguishing space, 170 . . . Plate-form portion, 171 . . . Contact bearing surface, 200 . . . Electromagnet unit, 201 . . . Magnetic yoke, 203 . . . Cylindrical auxiliary yoke, 204 . . . Spool, 208 . . . Exciting coil, 210 . . . Upper magnetic yoke, 214 . . . Return spring, 215 . . . Movable plunger, 216 . . . Peripheral flange portion, 220 . . . Permanent magnet, 225 . . . Auxiliary yoke

What is claimed is:

1. An electromagnetic contactor, comprising:

a contact device including a pair of fixed contacts disposed with a predetermined distance therebetween and a movable contact disposed to contact with and separate from the pair of fixed contacts, a contact housing case storing the contact device therein, and including an insulating cylinder having a tubular portion and a bottom plate portion forming a lower surface of the contact housing case, and an electromagnet unit disposed under the contact housing case and having a movable plunger, an auxiliary yoke and a permanent magnet, wherein the pair of fixed contacts includes support conductor portions supported with an upper surface of the contact housing case and arranged to maintain a predetermined interval between the support conductor portions, and C-shaped portions to form a C-shape, each including an upper plate portion linked to an end portion of the support conductor portion inside the contact housing case, an intermediate plate portion extending downward from a side of the upper plate portion opposite to that of the other support conductor portion, and a lower plate portion extending from a lower end of the intermediate plate portion toward a side of the other support conductor portion and formed with a contact portion on an upper surface thereof, and the bottom plate portion includes a projecting portion projecting toward the pair of fixed contacts to form a space for receiving the auxiliary yoke and the permanent magnet therein, and having contact bearing portions, each including an upper portion with a contact bearing surface and located under a leading end portion of the lower plate portion in the C-shaped portion, and side portions extending downwardly from two sides of the upper portion, the contact bearing portions bearing sides of the lower plate portions of the pair of fixed contacts, opposite to the movable contact.

2. The electromagnetic contactor according to claim 1, wherein two outer sides of each of the contact bearing portions are formed with arc extinguishing portions lower than the contact bearing surface.

3. The electromagnetic contactor according to claim 2, wherein the contact bearing portion is formed to bear only a center of the leading end portion of the lower plate portion in the C-shaped portion of the fixed contact, and arc extinguishing space of the arc extinguishing portion on each of the two outer sides of each of the contact bearing portions is expanded.

4. The electromagnetic contactor according to claim 2, wherein the contact housing case includes a tubular body made of metal, the insulating cylinder disposed on an inner periphery of the tubular body and having an upper surface being open, and an insulating plate closing at least the upper surface of the insulating cylinder, and the insulating cylinder is formed with the projecting portion and arc extinguishing spaces.

5. The electromagnetic contactor according to claim 1, wherein the pair of fixed contact contacts except for the contact portion each is covered with an insulating cover, and the insulating cover is formed with an extended portion covering an inner surface of an insulating plate.

6. The electromagnetic contactor according to claim 1, wherein the projecting portion has a center portion formed between the contact bearing portions and holding the movable plunger, and the contact bearing portions house projecting portions of the permanent magnet and projecting portions of the auxiliary yoke therein.

7. The electromagnetic contactor according to claim 6, wherein the center portion of the projecting portion includes a depressed portion sandwiched between upper portions of the contact bearing portions, and each of the contact bearing portions has a width narrower than that of the lower plate portion in the C-shaped portion to bear only a center portion of the leading end portion of the lower plate portion, in a width direction of the lower plate portion.

8. The electromagnetic contactor according to claim 7, wherein the insulating cylinder includes arc extinguishing portions defined by the tubular portion, the contact bearing portions, and the bottom plate portion, and the arc extinguishing portions have arc extinguishing spaces therein for extinguishing arc generated between the movable contact and the pair of fixed contacts.

9. The electromagnetic contactor according to claim 6, wherein the electromagnet unit further includes a magnetic yoke formed in a U shape, and an upper magnetic yoke fixed on the magnetic yoke and having a through hole, the movable plunger has a peripheral flange portion and protrudes upwardly through the through hole of the upper magnetic yoke, and the permanent magnet and auxiliary yoke include projections disposed in the space of the projecting portion under the contact bearing portions.

* * * * *